United States Patent [19]

Canning et al.

[11] 4,271,761

[45] Jun. 9, 1981

[54] HIGH ACCELERATION CABLE DEPLOYMENT SYSTEM

[75] Inventors: Thomas N. Canning, Sunnyvale; Christopher E. Barns, Mountain View; James P. Murphy; Bobby Gin, both of San Jose; Robert W. King, Saratoga, all of Calif.

[73] Assignee: The United States of America as represented by the Administrator of the National Aeronautics and Space Administration, Washington, D.C.

[21] Appl. No.: 32,305

[22] Filed: Apr. 23, 1979

[51] Int. Cl.[3] ..... F42B 13/56

[52] U.S. Cl. ..... 102/504; 242/128

[58] Field of Search ..... 102/89, 63; 242/128

[56] References Cited

U.S. PATENT DOCUMENTS

| | | | |
|---|---|---|---|
| 2,274,264 | 2/1942 | Bickel | 102/63 |
| 2,373,364 | 4/1945 | Wellcome | 102/63 |
| 3,156,185 | 11/1964 | Hermann et al. | 102/89 |
| 3,163,711 | 12/1964 | Schindler | 174/116 |
| 3,202,372 | 8/1965 | Meline et al. | 242/128 |
| 3,286,947 | 11/1966 | Erickson | 242/128 |

OTHER PUBLICATIONS

"The Condensed Chemical Dictionary," Sixth Edition, 1962, by Rose, p. 147.

*Primary Examiner*—Harold J. Tudor

*Attorney, Agent, or Firm*—Darrell G. Brekke; John R. Manning

[57] ABSTRACT

A high acceleration umbilical cable deployment system for enabling electrical communication between a ballistic projectile forebody and an afterbody. A cable coiled on a spool is housed within a ballistic casing having a drag funnel at the rear end. The cable is sandwiched between a foam plug and the drag funnel before it leaves the forebody and is secured in a strain relief at the apex of a funnel in the afterbody. On deployment, when the bodies are separated, energies that would tend to rupture the cable are expended by the funnels, plug and strain relief.

13 Claims, 5 Drawing Figures

HIGH ACCELERATION CABLE DEPLOYMENT SYSTEM

ORIGIN

The invention described herein was made by employees of the U.S. Government and may be manufactured and used by or for the Government for governmental purposes without the payment of any royalties thereon or therefor.

BACKGROUND OF THE INVENTION

1. Field of the Invention

The present invention relates generally to cable deployment between bodies that are separated at high acceleration.

2. Description of the Prior Art

Heretofore, wire-guided missiles have been equipped with wire magazines wherein the wire is unwound from a spool and then passed through a ring secured in a funnel with a long neck. The ring purportedly collects insulation coating particles scraped from the wire and prevents them from interfering with movement of the wire. Such a wire magazine is disclosed in U.S. Pat. No. 3,286,947, Nov. 22, 1966.

In the field of wire-guided rockets, it is also known to use a small auxiliary wire coil in addition to a main coil. The two coils are disposed so that the auxiliary coil is unwound before the main coil. In the wire dispenser of U.S. Pat. No. 3,266,423, Aug. 16, 1966, the auxiliary coil is pancake shaped and the main coil is cylindrical.

U.S. Pat. No. 3,613,619, Oct. 19, 1971, discloses a payout coil apparatus for a wire-guided torpedo. The coil is not supported by a mandrel or spool. The free-standing coil is housed in a simple container which has a conical casing surrounding the wire exit orifice. The following U.S. patents also show devices wherein a wire or thread is removed from a supply spool and pulled through a hopper or a cone: U.S. Pat. Nos. 2,170,194; 2,858,088; 3,389,875; and 4,135,679.

Lightning is a hazard to tall rockets during fueling and during ascent from the launch pad through storm clouds. Investigators explored a wire deployment process for triggering lightning prior to a hazardous rocket activity and wrote about the effort in *Journal of Spacecraft and Rockets,* Vol. 9, No. 9, Sept. 1972, pp. 631–632. Attempts were made to deploy a single wire from a rocket fired (with 70 g acceleration) into a storm cloud. Irrespective of whether the wire end was anchored to the ground site or not, only 15–60 m of wire was deployed before the wire was permanently deformed into a sequence of curls and loops that tightened into kinks causing the wire to break.

There has developed a need for a cable deployment system that will safely pay out cable under high acceleration, high velocity conditions. More particularly, it is desired to provide a deployment system whereby a ballistic forebody can be separated from an afterbody at a very high acceleration and maintain reliable electrical communication between the bodies via a multiple-conductor cable that is deployed from the forebody.

BRIEF SUMMARY OF THE INVENTION

The principal object of the present invention is to provide an improved deployment system that will safely pay out a cable from a ballistic forebody when the forebody is separated from an afterbody to which the cable is secured and when the separation is marked by high acceleration and velocity.

This and other objects of the present invention as shall hereinafter become apparent can be attained by the provision of means for dissipating the potentially destructive energies associated with the deployed cable. A projectile-like forebody is releasably attached to an afterbody. When the two bodies are separated, a cable is deployed from the forebody and the end of the cable is anchored to the afterbody. The forebody includes a ballistic casing with a circular opening at the rear end. A cylindrical spool with a cable coiled thereabout is secured within the casing. A cable funnel occupies the casing opening and provides an egress for the cable. A foam plug fills the inside of the funnel and wedges the cable against the interior wall of the funnel. The afterbody has a second funnel with a tubular strain relief fixed at the center thereof. In operation, when the bodies are separated with high acceleration, the cable is deployed from the forebody after the cable cuts and grinds away a conical passageway in the foam. The cutting process dissipates some of the shock as the cable is first pulled away from the spool. The axial acceleration prompts unwinding of the cable from the spool and helical and rotational cable motions are generated. As the cable is rotationally rubbed against each funnel, rotational energy is dissipated that would tend to rupture the cable. The tubular strain relief protects the cable at the point of greatest flexing.

FIGS. *3a–3c* are elevational views, partially sectioned, of a soil penetrating, geophysical monitor made in accordance with the instant invention.

DESCRIPTION OF THE PREFERRED EMBODIMENT

Figure 1:
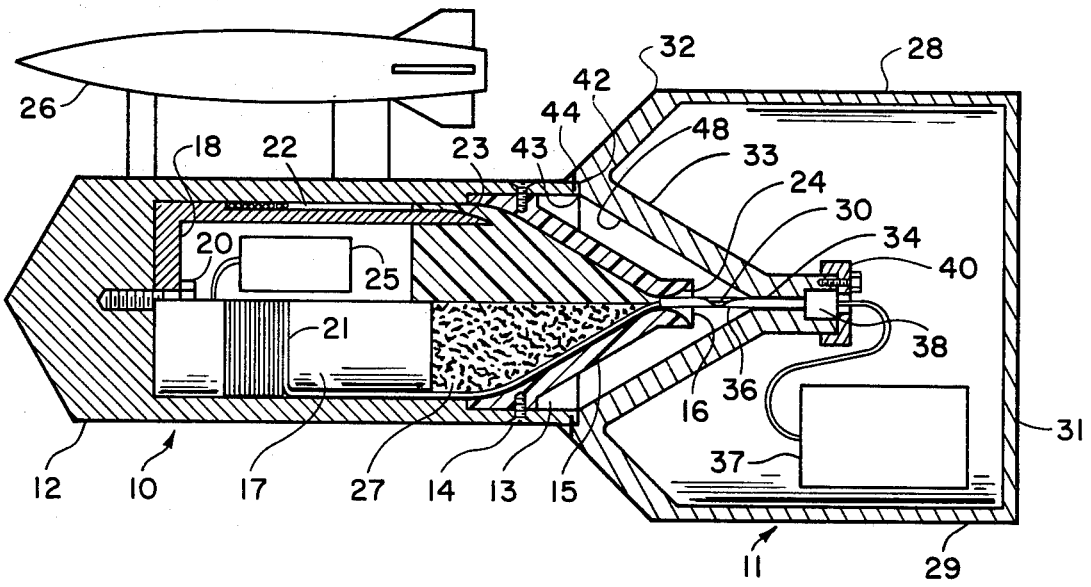
FIG. 1 is a side elevational view, mostly sectioned, of a cable deployment system according to the invention.

Referring now to FIG. 1, there is shown a high acceleration umbilical cable deployment system in accordance with the present invention. Forebody 10 includes a ballistic cylindrical casing 12 with a pointed nose and an annular opening 13 at the rear end. Screws 14 secure a drag funnel 15 to the interior wall of housing 12 at the opening. The center of annular opening 16 in funnel 15 coincides with the longitudinal axis of housing 12. Where the inner surfaces of casing 12 and funnel 15 meet, the surfaces are flush. Funnel 15 is preferably fabricated from a plastic material such as Delrin ®.

One end of cylindrically-shaped spool 17 is open and the other end is closed with plate 18. Spool 17 is fastened to casing 12 by means of screw 20. A portion of the spool has an outer diameter that is less than the inner diameter of housing 12. A cable 21 is coiled around this portion of the spool 17. Preferably, the cable is wound in a single layer and gap 22 is just slightly larger than the thickness of the cable. Cable 21 is comprised of one or more insulated wires that can carry an electrical current. A beryllium-copper alloy was found to be the most suitable conductor material. The alloy contains the desirable mechanical properties of high tensile strength (175,000 psi) and acceptable elongation with low electrical resistance. The wire may be insulated with an enamel-like coating of Formvar ® which is tough and lightweight. In one apparatus made in accordance with the subject invention, the cable was fabricated by twisting six conductors around a seventh (in the center) and the resulting cable had a diameter of 0.079 cm. End surface 23 of spool 17 and inner surface 24 of funnel 15 at opening 16 are curved to prevent payout hangups and to reduce wear on the cable as it is deployed. One end of cable 21 is connected to device 25. Device 25 may comprise, for example, one or more transducers, filters, amplifiers, or other electrical components. The interior of funnel 15, a portion of gap 22, and a portion of the spool cavity is filled with a tight-fitting, low density, cellular, plastic plug 27. A suitable material for the plug has been found to be polyurethane foam. Only a few symbolic turns of the cable have been depicted in FIG. 1. In practice, the spool, cable coil, and plug geometrics are arranged so that the last turn of the coil touches the plug. Cable 21 is threaded from spool 17 through opening 16 of funnel 15 to afterbody 11. Cable 21 is tightly sandwiched between the outer surface of plug 27 and the inner wall of funnel 15.

Afterbody 11 includes a housing 28 comprising a cylindrical wall 29, a disc-shaped wall 31, an annulus 32 and a funnel 33. Funnel 33 has a centrally-disposed, stepped-diameter passageway 34. Mounted within the passageway 34 is a flexible, stepped-diameter strain relief 36 with an annular longitudinal channel slightly larger than the cable 21. Cable 21 passes from forebody 10 through tubular strain relief 36 and terminates at device 37. Device 37 may be, for example, one or more of the following: a recorder, a power supply, an amplifier, a transmitter or a readout apparatus. The space between the inner wall of strain relief 36 and cable 21 is filled with an adhesive such as epoxy cement. A suitable material for strain relief 36 is Teflon®. Axial movement of strain relief 36, and the cable cemented therein, is restricted by shoulder 38 of passageway 34 and cap 40.

The outermost section of funnel 33 has a circular groove 42. End 43 of housing 12 rests in groove 42. The forebody 10 and afterbody 11 are temporarily secured together, before cable deployment, by a friction fit, detents, or one or more shear pins 44.

In operation, forebody 10 is separated from afterbody 11 by a propulsive device 26 which may be, for example, a rocket. Propulsive device 26 can be a rocket much larger than forebody 10 and forebody 10 can be mounted either within or without the rocket. Alternatively, both afterbody 11 and forebody 10 can be dropped on or fired at an appropriate target simultaneously. On target impact, afterbody 11 will be "caught" by the target, forebody 11 will continue and cause body separation and cable deployment. If forebody 10 is accelerated by propulsive device 26 or if both bodies are moving (after being dropped, fired from a gun, etc.) and afterbody 11 suddenly decelerates (for example, after impacting a target such as soil), forebody 10 is separated from afterbody 11. If shear pins 44 are employed, they are severed by the acceleration or deceleration. As the forebody moves away from the afterbody, cable 21 unwinds from spool 17 and develops a large rotational velocity and a high rotational kinetic energy that could cause twisting and torsional failure. The cable 21 cuts and grinds a conical passageway in plug 27 adjacent to the interior wall of drag funnel 15. The funnel serves as a cable guide to reduce the magnitude of the spin velocity through friction. As the funnel diameter decreases, the umbilical cable scrubs the funnel wall. The foam plug and the funnel wall cause the cable to yield its rotational energy to friction-produced heat. The afterbody 11, which serves as the anchor for the umbilical cable, features a funnel 33. Cable rotational energy is dissipated through scrubbing action between cable 21 and funnel surface 48. Tubular plastic strain relief 38, working on the converging shape of the funnel, helps to protect the cable at the point of greatest flexing. Thus, by dissipating rotational energy in the deployed cable, integrity is maintained and electrical communication between device 37 in afterbody 11 and device 25 in forebody 10 is uninterrupted.

Figure 2:
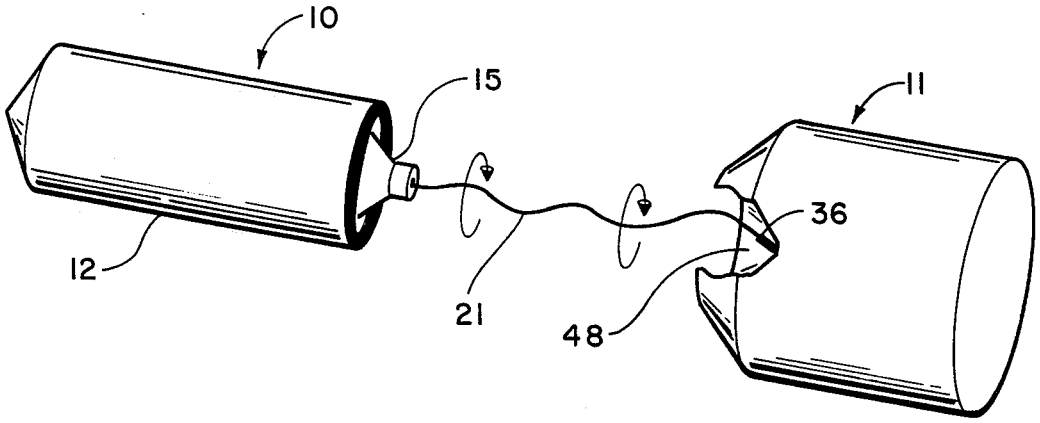
FIG. 2 is a fragmented perspective view of the system of FIG. 1.
Figure 3A:
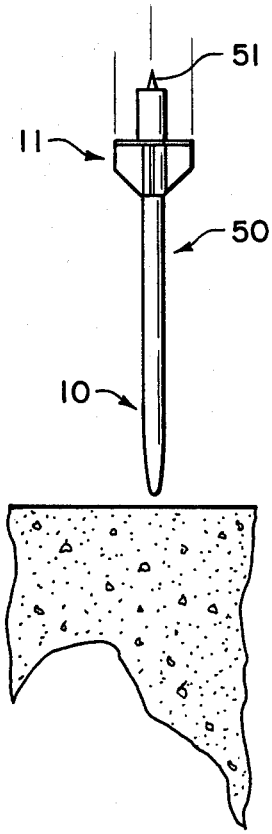
Figure 3B:
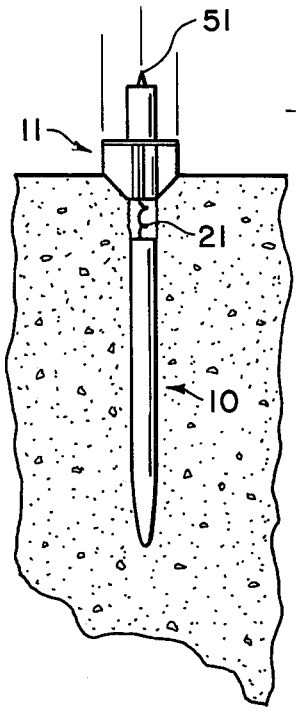
Figure 3C:
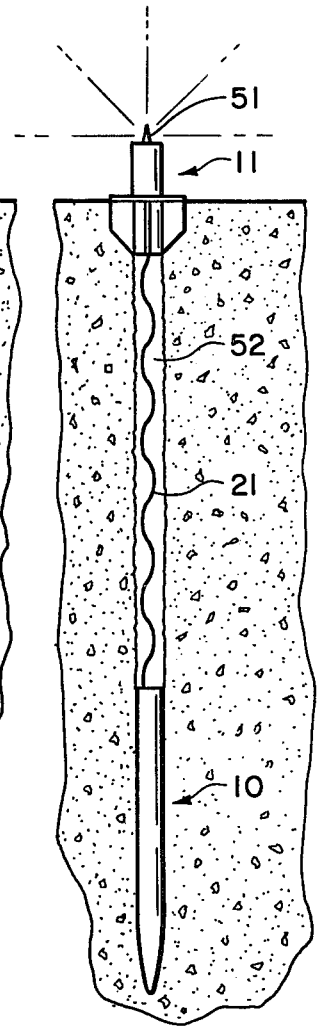

The subject invention was tested in the ballistic ranges at NASA-Ames Research Center. A joined afterbody and forebody according to the invention were fired from a smooth bore gun at a stripper. The stripper comprised a sandwich of multiple layers of plywood and aluminum. The stripper contained an aperture which was only large enough to pass the forebody. When the gun was fired, the forebody passed through the stripper at a velocity of 150 m/s and the afterbody impacted the stripper with a deceleration of 20,000 g's. The afterbody separated from the forebody and the cable was deployed from the forebody until the forebody was stopped in a plywood box filled with layers of Celotex® and particle board. During flight, the forebody destroyed break wires that triggered monitoring instruments such as shadowgraphs and high speed movie cameras. FIG. 2 depicts the helical cable pattern that was observed during testing as cable 21 was deployed from forebody 10. Tests were performed using a seven-conductor Be-Cu cable, a 49-conductor Be-Cu cable, and a stainless steel cable that is known and sold as "aircraft cable." All of the cables survived the 20,000-g deployment.

FIGS. *3a–3c* depict a soil penetrator 50 in accordance with the instant invention for measuring geophysical conditions and transmitting the measured data to a remote location (not shown). The penetrator may be dropped from a helicopter, aircraft or spacecraft, or it may be propelled to the landing site by rocket power. In FIG. *3a*, the forebody 10 is still connected to afterbody 11 and the nose of forebody 10 is just about to impact the soil. In FIG. *3b*, the penetrator has contacted the soil and forebody 10 is burrowing downward. Due, in part, to the difference in shaping and cross-sectional areas the forebody 10 finds it easier to travel through the soil than afterbody 11. Accordingly, the two bodies are separated with a great acceleration, afterbody 11 is left at the soil surface, and cable 21 is deployed from forebody 10 as it plummets downward through the soil. In a free fall situation, soil penetrator 50 could, for example, achieve a velocity of 500 ft/sec before impact and at the time of impact, afterbody 11 could, depending on soil characteristics, experience a 20,000-G deceleration. Finally, in FIG. *3c*, forebody 10 has stopped traveling through the crust and transducers (temperature conductivity probe, geophone, magnetometer, etc.) within forebody 10 are monitoring predetermined conditions of the ambient environment. The signals from the transducers are amplified and channeled through cable 21 to afterbody 11. Afterbody 11 contains a transmitter 51 that transmits an r-f signal modulated with the data monitored by the transducers in forebody 10. Inasmuch as the cable 21 is deployed from forebody 10 instead of afterbody 11, it is immaterial whether all or part of hole 52 immediately collapses.

Although the invention has been herein shown and described in what is conceived to be the most practical and preferred embodiment, it is recognized that departures may be made therefrom within the scope of the invention, which is not to be limited to the illustrative details disclosed.

What is claimed is:

1. An umbilical cable deployment system comprising:

a ballistic forebody with an afterbody detachably engaged thereto;

said forebody having a supply of cable with the distal end of said cable being anchored to said afterbody;

means within said forebody for causing said cable to be deployed in a helical pattern with rotational energy when said forebody is separated from said afterbody;

means within said forebody for dissipating some of said cable rotational energy, said dissipating means including a member adapted to be temporarily secure a section of said cable and be abraded by said cable when said forebody is separated from said afterbody said dissipating means including a drag funnel and said member being a low density plug that tightly fits within the interior of said drag funnel and presses said section of said cable against said funnel inner surface prior to a forebody/afterbody separation; and means within said afterbody for dissipating some of said cable rotational energy.

2. A system as described in claim 1 wherein said plug is made of polyurethane foam.

3. A system as delineated in claim 1 wherein said afterbody rotational energy dissipating means includes a funnel having a cone-shaped portion and a tube located at the apex of said cone-shaped portion, said cable extending from said forebody through said cone-shaped portion and then said tube whereby said cable is permitted to rotationally rub against the inner surface of said cone-shaped portion of said afterbody funnel.

4. A system as set forth in claim 3 wherein said afterbody rotational energy dissipating means further includes a strain relief secured to the inner passageway of said tube and said cable is threaded through said strain relief.

5. A system as claimed in claim 1 wherein a means is provided for propelling said forebody.

6. A system as set forth in claim 1 wherein said cable comprises a plurality of Be-Cu alloy conductors.

7. A system as described in claim 1 wherein cable integrity is maintained when the differential acceleration between the forebody and afterbody is 20,000 g's at the time of separation.

8. An umbilical cable deployment system comprising:

a ballistic forebody detachably joined to an afterbody;

said forebody including a spool, a cable, a foam plug with a conical head, and a drag funnel with a conical portion and a cable guide orifice at the apex of said conical portion, the majority of said cable being coiled about said spool and one end of said cable being threaded through said orifice to an anchor on said afterbody, said conical head of said plug occupying the interior of said conical portion of said drag funnel and pressing said cable tightly against the interior surface of said conical portion of said drag funnel;

said afterbody having a funnel with a conical portion the apex of which points toward the rear of said afterbody, said afterbody anchor comprising a tubular strain relief that is secured to the center of said afterbody funnel whereby said cable is permitted to rub the interior surface of each funnel during cable deployment.

9. A system as described in claim 8 wherein a means is provided for propelling said forebody.

10. A system as delineated in claim 8 wherein said cable comprises a plurality of Be-Cu alloy conductors.

11. A system as claimed in claim 8 wherein cable integrity is maintained when the differential acceleration between the forebody and afterbody is 20,000 g's at the time of separation.

12. An umbilical cable deployment system comprising:

a ballistic forebody detachably joined to an afterbody;

said forebody including a spool, a cable with first and second ends, a first electrical device, a conical foam plug, and a drag funnel with a cable guide orifice, the majority of said cable being coiled about said spool and said second end of said cable being threaded through said orifice to said afterbody, said first end of said cable being connected to said first electrical device, said plug being disposed within said drag funnel and pressing said cable tightly against the interior surface of said drag funnel;

said afterbody including a funnel having a conical portion the interior of which faces said forebody, a tubular strain relief, and a second electrical device, said strain relief being centrally fastened to said afterbody funnel, said cable near said second end being secured within said strain relief, and said second end of said cable being connected to said second electrical device.

13. A system as set forth in claim 12 wherein said first electrical device includes a transducer and said second electrical device includes a transmitter.

* * * * *